US007839337B2

(12) United States Patent
Hung et al.

(10) Patent No.: US 7,839,337 B2
(45) Date of Patent: Nov. 23, 2010

(54) MULTI-BAND ANTENNA

(75) Inventors: Chen-Ta Hung, Tu-cheng (TW); Hsien-Sheng Tseng, Tu-cheng (TW); Wen-Fong Su, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 197 days.

(21) Appl. No.: 12/220,524

(22) Filed: Jul. 24, 2008

(65) Prior Publication Data

US 2010/0019974 A1 Jan. 28, 2010

(30) Foreign Application Priority Data

Jul. 24, 2007 (TW) ..... 96126863 A

(51) Int. Cl.
*H01Q 1/38* (2006.01)
*H01Q 1/24* (2006.01)

(52) U.S. Cl. ..... 343/700 MS; 343/702; 343/846

(58) Field of Classification Search ..... 343/700 MS, 343/702, 846
See application file for complete search history.

(56) References Cited

U.S. PATENT DOCUMENTS

| | | | | |
|---|---|---|---|---|
| 7,289,071 | B2 | 10/2007 | Lam et al. | |
| 7,498,992 | B2 * | 3/2009 | Hung et al. | 343/702 |
| 7,554,498 | B1 * | 6/2009 | Lee et al. | 343/702 |
| 7,633,448 | B2 * | 12/2009 | Su et al. | 343/702 |
| 2008/0007461 | A1 * | 1/2008 | Su et al. | 343/700 MS |
| 2008/0252533 | A1 * | 10/2008 | Hung et al. | 343/700 MS |

* cited by examiner

*Primary Examiner*—Hoang V Nguyen
(74) *Attorney, Agent, or Firm*—Wei Te Chung; Andrew C. Cheng; Ming Chieh Chang

(57) ABSTRACT

A multi-band antenna includes an insulative supporting member, an antenna stripe comprising a ground element, a first antenna used for wireless wide area net and a second antenna used on wireless local area net, wherein said first antenna comprises a first radiating portion with a horizontal first feeding tab, said first radiating portion is separated from the grounding element, said antenna stripe surrounds the supporting member, said first radiating portion is fixed on the supporting member and covers plural faces of the supporting member.

20 Claims, 6 Drawing Sheets

MULTI-BAND ANTENNA

BACKGROUND OF THE INVENTION

1. Field of the Invention

The present invention relates generally to a multi-band antenna, and more particularly to a multi-band antenna suitable for built into an electronic device, such as notebook.

2. Description of the Prior Art

Wireless communication devices, such as cellular phones, notebook computers, electronic appliances, and the like, are normally equipped with an antenna that serves as a medium for transmitting and receiving electromagnetic signals such as data, audio, video or other signals.

In recent years, an inner antenna trends to combine a WLAN (Wireless Local Area Net) antenna and a WWAN (Wireless Wide Area Net) antenna together. WLAN adopts two communications protocols to as Bluetooth and Wi-Fi. Bluetooth works in 2.4 GHz, and Wi-Fi works in 2.4 GHz and 5 GHz. WWAN adopts three communications protocols of GSM (Global System for Mobile Communication), GPS (Global Positioning System) and CDMA (Code Division Multiple Access). Working frequency of the GSM is 900/1800 MHz, and working frequency of the GPS is 1.575 GHz. CDMA includes three kinds of communication protocol to as CDMA2000, WCDMA and TD-SCDMA. Working frequency of the CDMA2000 is 800, 900, 1700, 1800, 1900, and 2100 MHz. Working frequency of the WCDMA is 1800, 1900, and 2100 MHz. And TD-SCDMA is limited in 900, 1800, and 2100 MHz.

Accordingly, it is preferable that an antenna of a notebook could cover above-described working environment, while the portable electronic device is capable of working in WLAN and WWAN. Currently, the portable electronic device is usually built-in with two antennas for respectively working in the WLAN and WWAN. However, portable electronic devices promote to be smaller and thinner so that receiving two antennas therein become more and more difficult and challenging.

U.S. Pat. No. 7,289,071 discloses a multi-band antenna capable of working at WWAN and WLAN environments. The multi-band antenna is capable to work in both WWAN and WLAN at the same time.

However, the such multi-band antenna has comparably limited working frequencies, and is not capable to cover some frequency bands of WWAN. In addition, the design of two antennas sharing the common edge of a grounding element makes the WLAN antenna and the WWAN antenna influence each other to reduce the radiating performance of the antenna.

Hence, in this art, a multi-band antenna to overcome the above-mentioned disadvantages of the prior art will be described in detail in the following embodiment.

BRIEF SUMMARY OF THE INVENTION

A primary object, therefore, of the present invention is to provide a multi-band antenna which is an PIFA.

In order to implement the above object and overcomes the above-identified deficiencies in the prior art, the multi-band antenna comprises an insulative supporting member, an antenna stripe comprising a ground element, a first antenna used for wireless wide area net and a second antenna used on wireless local area net, wherein said first antenna comprises a first radiating portion with a horizontal first feeding tab, said first radiating portion is separated from the grounding element, said antenna stripe surrounds the supporting member, said first radiating portion is fixed on the supporting member and covers plural faces of the supporting member.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
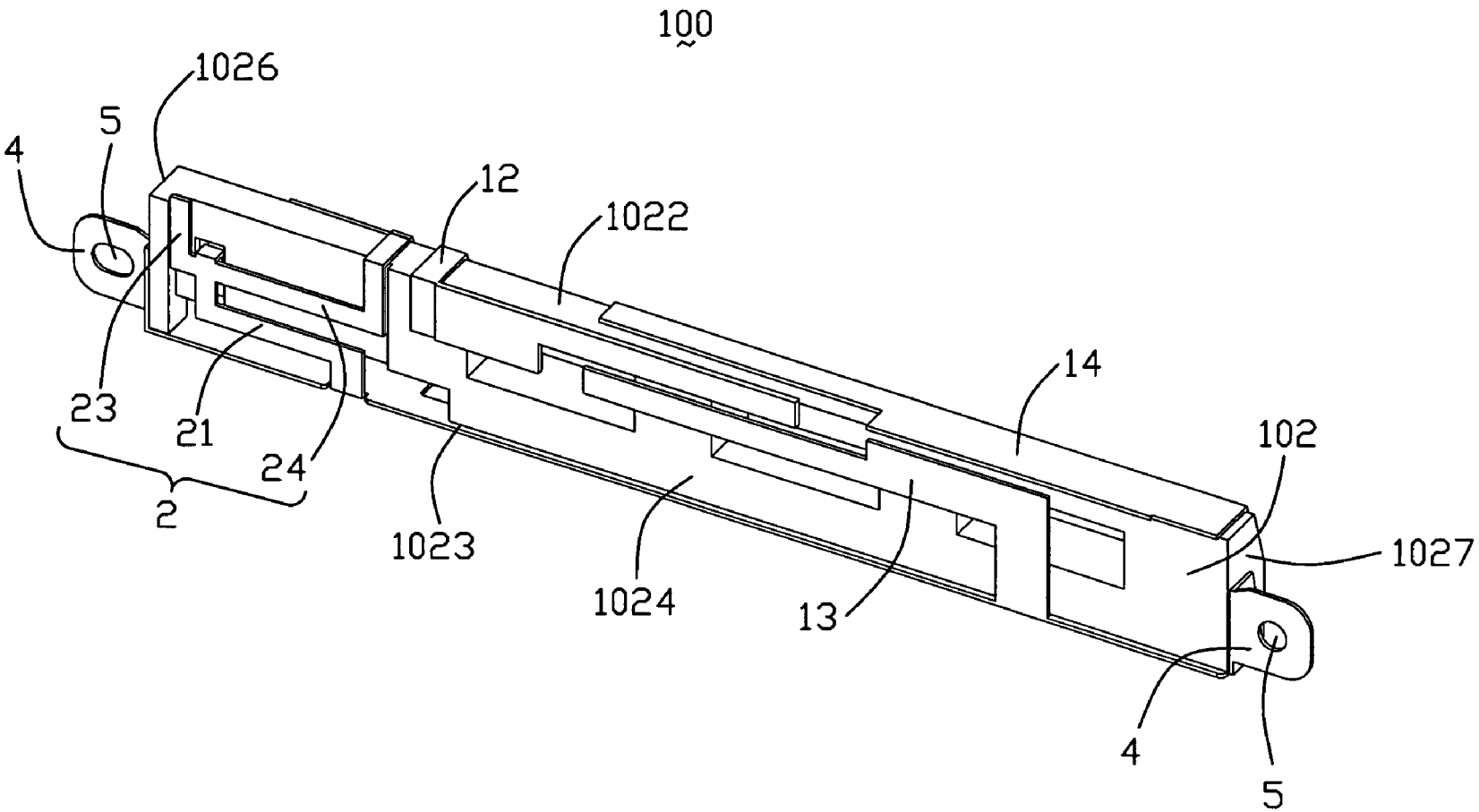
FIG. 1 is a perspective view illustrating a preferred embodiment of a multi-band antenna in according with the present invention.
Figure 4:
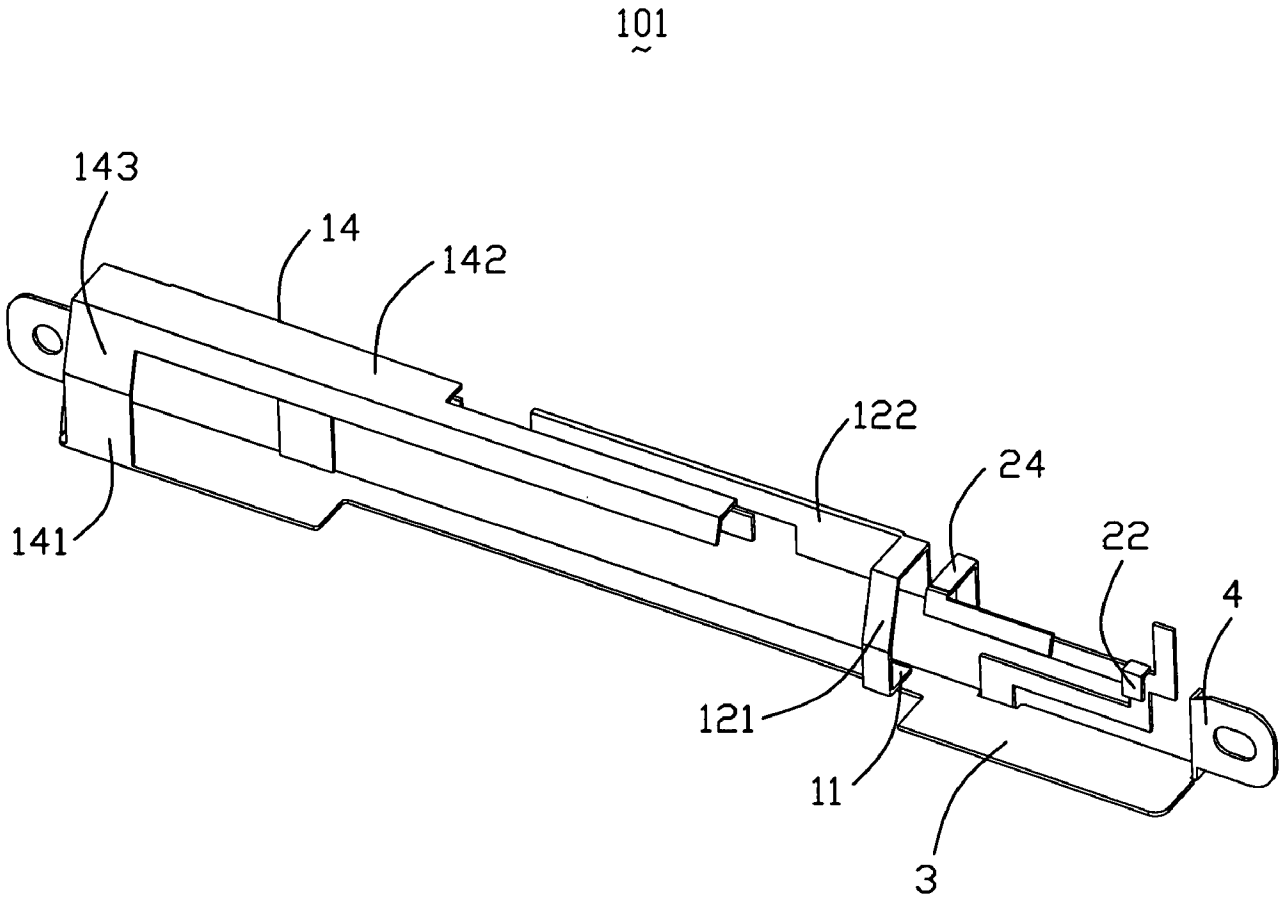
FIG. 4 is a perspective view of FIG. 3, but viewed from a different angle.

Reference to FIGS. 1 and 4, a multi-band antenna 100 in accordance with a preferable embodiment of the present invention is shown. The multi-band antenna 100 comprises an antenna stripe 101 and a supporting member 102. The antenna stripe 101 comprises a horizontal grounding element 3 with a pair of setting portions 4, 5, a first antenna 1 and a second antenna 2.

The supporting member 102 is made from insulative material and the antenna stripe 101 surrounds the supporting member 102 to fix the supporting member 102 therein. The supporting member 102 comprises plural grooves 1021 to protect the radiating effect of the antenna stripe 101 from being reduced. The antenna stripe 101 is bend to adapt to the shape of the supporting member 102.

The supporting member 102 is of an lengthwise column and comprises an upside 1022, an bottom 1023, a foreside 1024, a rearward 1025, a left side 1026 and a right side 1027. The rearward 1025 is composed of two continuous faces, and an angle is between the two faces.

The first antenna 1 works on wireless wide area net, and comprises a first radiating element 12 separated from the grounding element 102, a vertical first coupling radiating sheet 13 extending from one side of the grounding element 102, and a second coupling radiating sheet 14 extending from the other side of the grounding element 102 opposite to the first coupling radiating sheet 13. The first radiating element 12 comprises a horizontal tab 11, a vertical L-shape metal sheet 122 extending along a horizontal direction and a connecting portion 121 connecting the metal sheet 122 and the first feeding tab 11.

The first coupling radiating sheet 13 is similar to L shape and comprises a first arm 131 perpendicularly extending from the grounding element 102 along a vertical direction and a second arm 132 perpendicularly extending from the first arm 131 along a horizontal direction. The first coupling radiating sheet 13 couples the first radiating element 12 to produce a first lower frequency band which is from 1.7 GHz to 2.2 GHz frequency.

The second coupling radiating sheet 14 comprises a vertical first piece 141 perpendicularly extending from the grounding element 102, an L-shape horizontal second piece 142, and an L-shape piece 143 connecting the first piece 141 and the second piece 142. The second coupling radiating sheet 14 couples the first radiating element 12 to produce a second higher frequency band which is from 820 MHz to 960 MHz.

Figure 5:
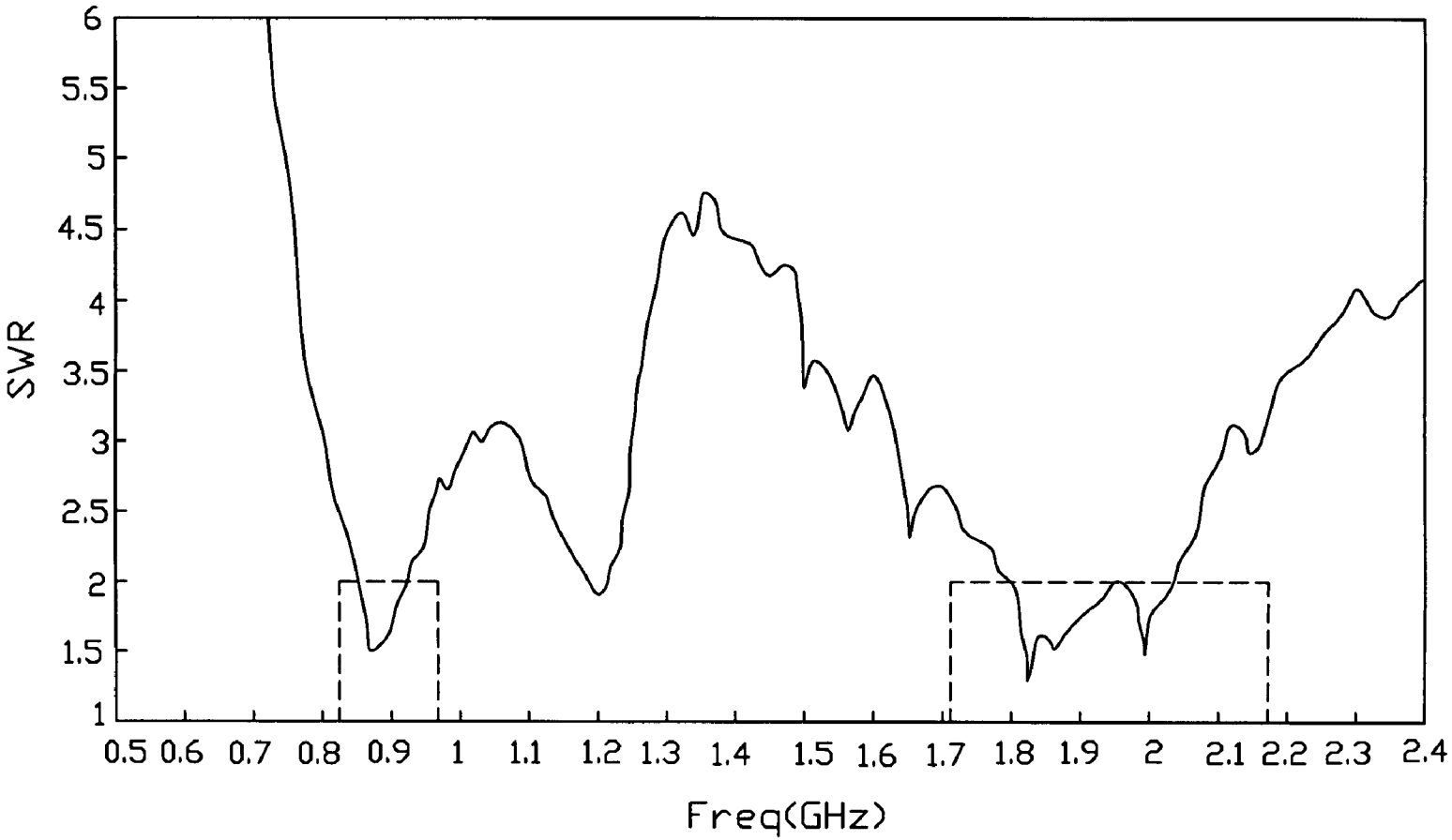
FIG. 5 is a test chart recording for the multi-band antenna of FIG. 1, showing Voltage Standing Wave Ratio (VSWR) as a function of WWAN frequency.

The first antenna 1 further comprises a feeding line 15. The feeding line 15 comprises an inner conductor 151 connecting the first feeding tab 11 and an outer conductor 152 connecting the grounding element 102. Reference to FIG. 5, the multi-band antenna 100 works at 1.7 GHz-2.2 GHz and 820 MHz-960 MHz frequency bands to be suitable to be used under the standard of WWAN, GSM, CDMA200, WCDMA and TD-SCDMA.

The second antenna 2 comprises a connecting portion 21 perpendicularly extending from the grounding element 3, an L-shape second feeding tab 22, a second radiating portion 23 and a third radiating portion 24. The connecting portion 21 is Z shape and connecting the grounding element 102 with the second and third radiating portion 23, 24. The second radiating portion 23 is L shape and has an end upwardly extending along a vertical direction. The third radiating portion 24 connects the second radiating portion 23 and comprises an L-shape first strip 243 connecting the second radiating portion 23, an L-shape second strip 244 and a vertical third strip 245 connecting the first strip 243 and the second strip 244.

Figure 6:
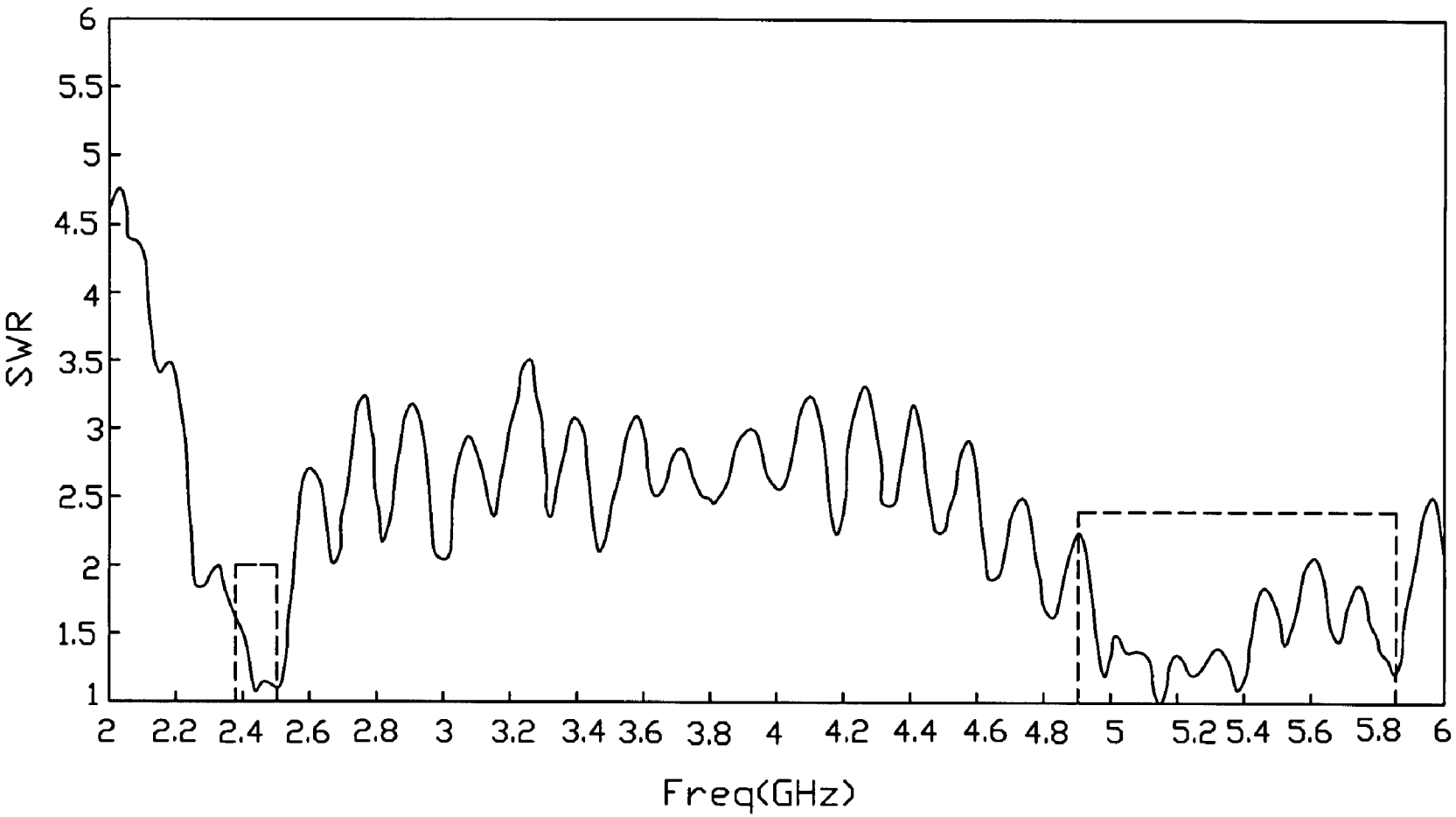
FIG. 6 is a test chart recording for the multi-band antenna of FIG. 1, showing Voltage Standing Wave Ratio (VSWR) as a function of WLAN frequency.

The second antenna 2 further comprises a feeding line 25. The feeding line 25 comprises an inner conductor 251 connecting the second feeding tab 22 and an outer conductor 252 connecting the grounding element 102. The second radiating portion 23 works at a lower frequency band of the second antenna 2 and the third radiating portion 24 is used on a higher frequency band of the second antenna 2. Reference to FIG. 6, the second antenna 2 produces 2.4 GHz-2.5 GHz and 4.9 GHz-5.86 GHz frequency bands which can cover the working bands of WLAN.

The two setting portions 4 is L shape, and upwardly extends from the two ends of the grounding element 3. The two setting portion 4 respectively comprises a hole 5 to assemble the multi-band antenna 100 on the electric device.

Figure 2:
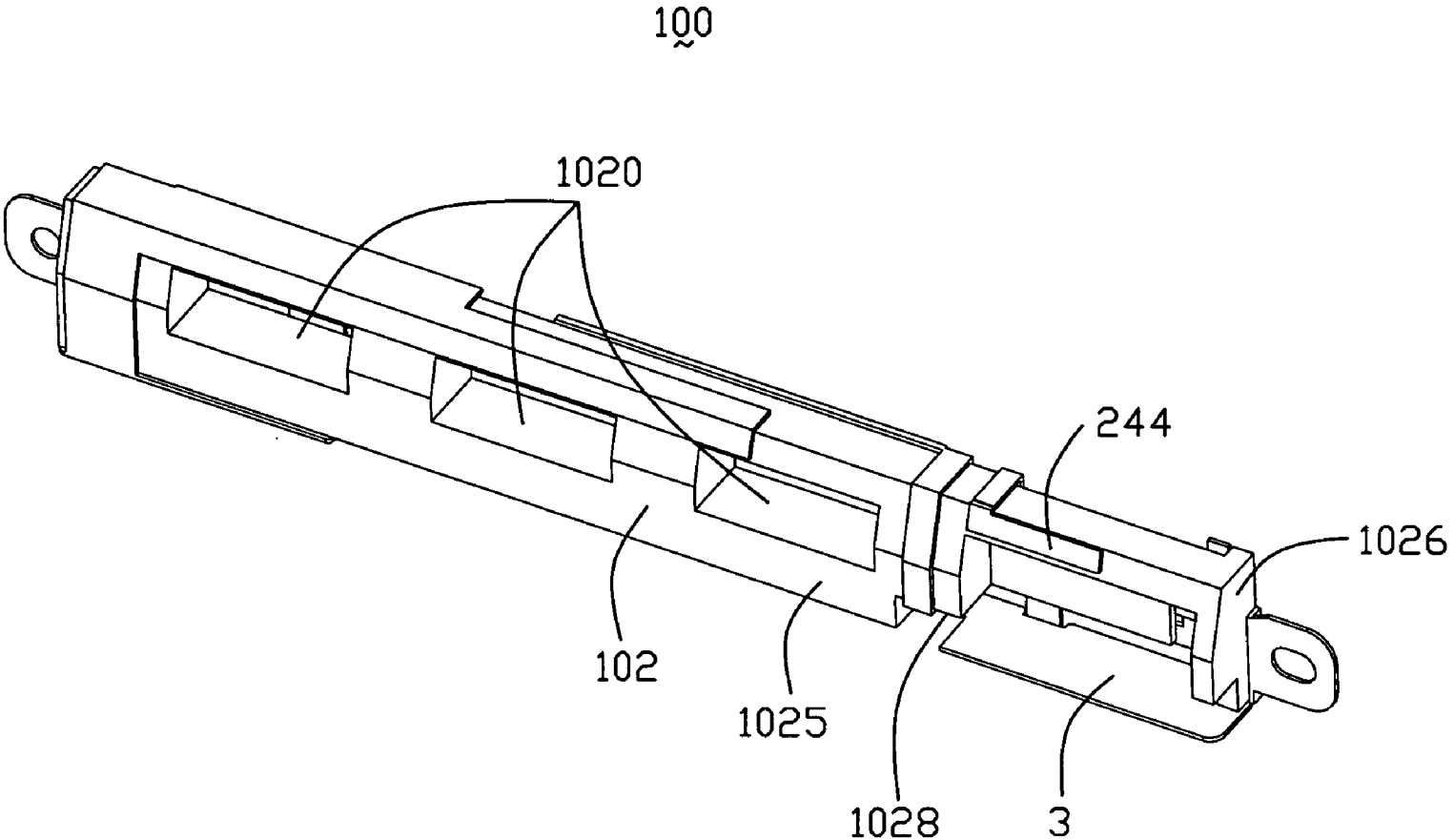
FIG. 2 is a perspective view of FIG. 1, but viewed from a different angle.
Figure 3:
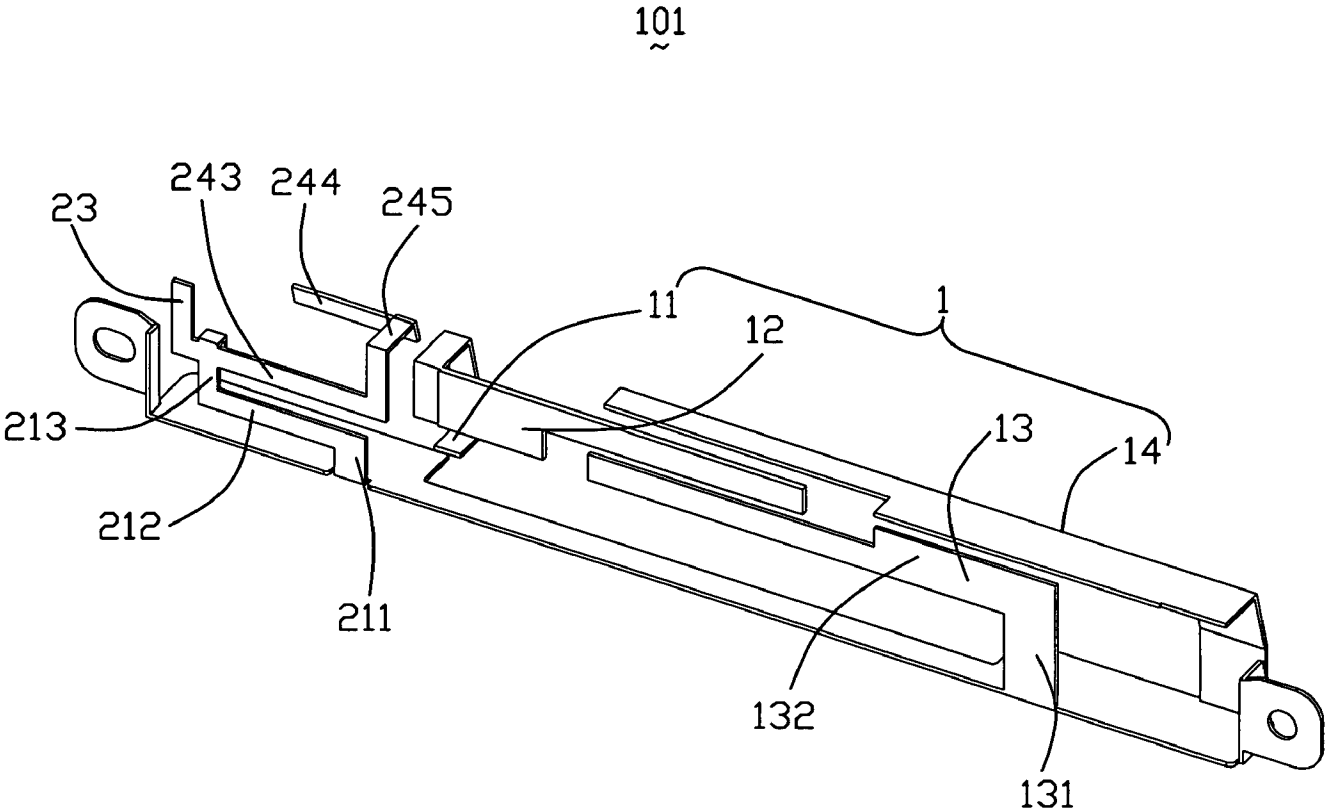
FIG. 3 is a perspective view of FIG. 1 without a supporting member.

Reference to FIG. 2 the bottom 1023 of the supporting member 102 is attaches to the grounding element 3 of the multi-band antenna 100 and the second coupling radiating sheet 14 surrounds the rearward 1025 and the upside 1022 of the supporting member 102. The third radiating portion 24 surrounds the foreside 1024, upside 1022 and rearward 1025 of the supporting member 102. The left side 1026 and right side 1027 respectively attach to the two setting portions 4. And then, the supporting member 102 is fixed in the inner space of antenna stripe 101. The first radiating portion 12 is fixed on the supporting member 102. The first feeding tab 11 is fixed on the higher bottom face 1028. The metal sheet 122 is fixed on the foreside 1024 and the connecting portion 121 passes through the rearward 1025, the upside 1022 and the foreside 1024. So the supporting member 102 is fixed among the antenna stripe 101. In addition, the connecting portion 21 and the second radiating portion 23 attach to the foreside 1024, the first coupling radiating sheet 13 attaches to the foreside 1024. In other embodiment, the shapes of the supporting member 102 and the antenna stripe 101 can be changed in according with the inner space of the electric device. The shape of the antenna stripe 101 is designed to adapt the supporting member 102 to make the antenna stripe 101 and the supporting member 102 assemble together to form an integer and make the first radiating portion 12 of the antenna stripe 101 fixed on the supporting member 102.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A multi-band antenna comprises:

an insulative supporting member;

an antenna stripe comprising a ground element, a first antenna used for wireless wide area net and a second antenna used on wireless local area net;

wherein said first antenna comprises a first radiating portion with a horizontal first feeding tab, said first radiating portion is separated and insulated from the grounding element without conductivity therebetween, said antenna stripe surrounds the supporting member, and said first radiating portion is fixed on the supporting member and covers plural faces of the supporting member.

2. The multi-band antenna as claimed in claim 1, wherein said supporting member is of a lengthwise column.

3. The multi-band antenna as claimed in claim 1, wherein said supporting member comprises six sides and the rearward of the supporting member is composed of two continuous faces.

4. The multi-band antenna as claimed in claim 3, wherein said first radiating portion further comprises a vertical L-shape metal sheet extending along a horizontal direction and a connecting portion connecting the metal sheet and the tab.

5. The multi-band antenna as claimed in claim 4, wherein said supporting member further comprises a cutout to form a higher bottom face, said first feeding tab of the first radiating portion attaches the higher bottom face, said metal sheet attaches the foreside and said connecting portion passes through the rearward and the upside and foreside.

6. The multi-band antenna as claimed in claim 3, wherein said second antenna comprises a second radiating portion separated from the grounding element, a third radiating portion, a second feeding tab and a connecting portion connecting the grounding element to the second and third radiating portions.

7. The multi-band antenna as claimed in claim 6, wherein said connecting portion and said second radiating portion of the second antenna attaches the foreside of the supporting member, said third radiating portion is bend to across the foreside, upside and rearward of the supporting member.

8. The multi-band antenna as claimed in claim 1, wherein said first antenna further comprises a first coupling radiating sheet upwardly extending from one side of the grounding element and a second coupling radiating sheet upwardly extending from the other side of the grounding element.

9. The multi-band antenna as claimed in claim 8, wherein said first coupling radiating sheet is of an L-like configuration and comprises a first arm perpendicularly extending from the grounding element along a vertical direction and a second arm perpendicularly extending from the first arm along a horizontal direction.

10. The multi-band antenna as claimed in claim 9, wherein said second coupling radiating sheet comprises a vertical first piece perpendicularly extending from the grounding element, an L-shape horizontal second piece and an L-shape third piece connecting the first piece and the second piece.

11. The multi-band antenna as claimed in claim 10, wherein said first coupling radiating sheet couples said first radiating portion to resonate a higher frequency and the second coupling radiating sheet couples said first radiating portion to resonate a lower frequency.

12. The multi-band antenna as claimed in claim 1, wherein said multi-band antenna further comprises a pair of L-shape setting portions respectively upwardly extending from the two ends of the grounding element.

13. The multi-band antenna as claimed in claim 1, wherein said supporting member comprises plural grooves to protect the radiating effect of the antenna stripe from being reduced.

14. A multi-band antenna comprising:

an insulative supporting member essentially being of a lengthwise column;

a grounding element extending in a lengthwise direction along said supporting member;

a first antenna located in a first position of said supporting member and including a first radiating element; and a second antenna located in a second position of said supporting member which is spaced from said first position in said lengthwise direction; wherein said second antenna unitarily extends from the grounding element while said first radiating element is separated and insulated from the grounding element without conductivity therebetween but independently supported by said supporting member.

15. The multi-band antenna as claimed in claim 14, wherein said first antenna further includes a first coupling radiating portion located beside said first radiating element for resonation in said lengthwise direction and unitarily extending from the grounding element.

16. The multi-band antenna as claimed in claim 15, wherein said first antenna further includes a second coupling radiating portion located beside said first radiating element for resonation in said lengthwise direction and spaced from the first coupling radiating portion in a transverse direction perpendicular to said lengthwise direction.

17. The multi-band antenna as claimed in claim 16, wherein said first coupling radiating portion and said second coupling radiating portion respectively extend from two sides of the said grounding element.

18. The multi-band antenna as claimed in claim 15, wherein said second antenna, the first radiating element, and said first coupling radiating portion are sequentially arranged along the supporting member in said lengthwise direction.

19. The multi-band antenna as claimed in claim 14, wherein the supporting member defines a plurality of holes extending therethrough in a transverse direction perpendicular to said lengthwise direction.

20. A multi-band antenna comprising:

an insulative supporting member essentially being of a lengthwise column;

a metallic antenna stripe wrapping said support member and including:

a grounding element extending in a lengthwise direction along said supporting member;

a first antenna located in a first position of said supporting member and including a first radiating element; and a second antenna located in a second position of said supporting member which is spaced from said first position in said lengthwise direction; wherein said first antenna further includes at least a coupling radiating portion extending from the grounding element and located beside the corresponding first radiating element for resonation in said lengthwise direction; wherein said second antenna and said coupling radiating portion are located by two sides of the first radiating element in said lengthwise direction.

* * * * *